US011264005B2

(12) United States Patent
Hutchinson et al.

(10) Patent No.: US 11,264,005 B2
(45) Date of Patent: Mar. 1, 2022

(54) INCUBATOR NOISE CONTROL SUPPORT

(71) Applicant: Invictus Medical, Inc., San Antonio, TX (US)

(72) Inventors: George Martin Hutchinson, San Antonio, TX (US); Lilin Du, San Antonio, TX (US)

(73) Assignee: Invictus Medical, Inc., San Antonio, TX (US)

( * ) Notice: Subject to any disclaimer, the term of this patent is extended or adjusted under 35 U.S.C. 154(b) by 0 days.

(21) Appl. No.: 17/020,725

(22) Filed: Sep. 14, 2020

(65) Prior Publication Data

US 2021/0082389 A1 Mar. 18, 2021

Related U.S. Application Data

(60) Provisional application No. 62/900,620, filed on Sep. 15, 2019.

(51) Int. Cl.
*G10K 11/178* (2006.01)
*A61G 11/00* (2006.01)

(52) U.S. Cl.
CPC ..... *G10K 11/17881* (2018.01); *A61G 11/00* (2013.01); *G10K 11/17857* (2018.01); *A61G 2203/10* (2013.01); *A61G 2203/30* (2013.01); *A61G 2210/30* (2013.01); *G10K 2210/116* (2013.01)

(58) Field of Classification Search
CPC ..... G10K 11/17881; G10K 11/17857; G10K 2210/116; A61G 11/00; A61G 2203/10; A61G 2203/30; A61G 2210/30
USPC ..... 381/71.1
See application file for complete search history.

(56) References Cited

U.S. PATENT DOCUMENTS 6,409,654 B1 * 6/2002 McClain ..... G16H 30/20 600/22
2002/0173696 A1 * 11/2002 Kolarovic ..... A61B 5/01 600/22
2014/0003614 A1 1/2014 Levitov et al.
2014/0307888 A1 10/2014 Alderson et al.
2016/0199241 A1 7/2016 Rapoport
2017/0084264 A1 3/2017 Kuo et al.
2018/0122358 A1 5/2018 Bhimavarapu et al.

* cited by examiner

*Primary Examiner* — David L Ton
(74) *Attorney, Agent, or Firm* — Robert A. Lawler

(57) ABSTRACT

A support structure for active noise control systems is provided. The support structure may be used with active noise control systems in enclosed spaces such as a neonatal incubator.

20 Claims, 4 Drawing Sheets

INCUBATOR NOISE CONTROL SUPPORT

CROSS-REFERENCE TO RELATED APPLICATIONS

This application claims the benefit of U.S. Provisional App. Ser. No. 62/900,620, filed Sep. 15, 2019.

BACKGROUND OF THE INVENTION

The present invention relates generally to support structures for active noise control systems.

Technological advances in neonatal intensive care have contributed greatly to decreases in infant mortality. The neonatal intensive care unit (NICU) clinical team must provide support of basic functions including temperature and humidity control, nutritional support, fluid and electrolyte maintenance, respiratory support, and skin integrity management. However, the mission of NICU care is also to support the healthy development of the infant. A critical component of healthy development is limiting the noxious noise to which the patient is exposed while providing appropriate aural stimulation to promote brain and language development. In the same way that technology has been brought to bear on the physiologic needs through incubators for temperature and humidity management or ventilators for respiratory support, it can also be applied to address these developmental concerns.

Noise levels in NICUs have been shown to be consistently louder than guidelines provided by the American Academy of Pediatrics (AAP). These guidelines stipulate that the noise levels that the hospitalized infants are exposed to should not exceed 45 dB, A-weighted (dBA), averaged over one hour and should not exceed a maximal level of 65 dBA averaged over one second. Noise measured both inside and outside an incubator show guidelines are frequently exceeded throughout the day.

Looking specifically at the sources of noise in the NICU, most are life-critical devices or communication between caregivers, which is often essential for proper care of patients. Specifically, the continuous positive airway pressure (CPAP) device and bradycardia alarms have been reported as between 54 and 89 dBA. Other noise sources include incubator alarms, IV pump alarms, general conversation, telephones, intercom bells, high frequency oscillatory ventilators, televisions, and trolleys or cars. Many of these are essential elements of safe NICU care; their use is not optional, yet they provide a noise hazard to the patient population.

Health risks from noise exposure are many and significant. One growing concern is the indication that NICU noise negatively impacts intellectual development. Hearing loss may be another long-term sequela of NICU noise. It is intuitive that increased noise levels will interfere with the sleep of an infant and this correlation is demonstrated in numerous studies. Adequate sleep is essential for normal development and growth of preterm and very low birth weight infants and can enhance long-term developmental outcomes. Similarly, it has been shown that noise increases various measures of stress in hospitalized infants. Stress is quantified through many surrogates including vital signs, skin conductance, and brow furrowing. While excessive noise is shown to be detrimental to the well-being of the hospitalized infant, proper exposure to human voices, especially in directed communication between parents and the infant, is proving to be beneficial. A correlation exists between the amount of adult language the preterm infant is exposed to in the NICU and the quantity of reciprocal vocalizations and meaningful early conversations.

Active noise control (ANC) may comprise sampling an original varying sound pressure waveform in real time, analyzing the characteristics of the sound pressure waveform, generating an anti-noise waveform that is essentially out of phase with the original sound pressure waveform, and projecting the anti-noise waveform such that interferes with the original sound pressure waveform. In this manner, the energy content of the original sound pressure waveform is attenuated.

Early implementations of this technique were realized with analog computers as early as the 1950s. However, these analog implementations were not able to adapt to changing characteristics of the noise as the environmental conditions changed. With digital technology, adaptive ANC became possible. Sound waves are described by variations in acoustic pressure through space and time where acoustic pressure is the local deviation from atmospheric pressure caused by the sound wave. Incident sound waves can superimpose one upon another in which the net response at a given position and time is the algebraic sum of the waveforms at that point and time. This is known as constructive interference if the resulting pressure is greater than the pressure of any of the incident waveforms and destructive interference if the resulting pressure is less than any of the incident waveforms.

An active noise control system suitable for use with the present invention is described in U.S. Pat. No. 10,410,619, the entire contents of which are incorporated by reference as if set forth in their entirety herein. The ANC system is provided for use proximate a support surface in an environment with multiple noise sources that to emit noise sound waves either on a constant, periodic, or irregular basis. The active noise control system comprises an array of reference input sensors arranged essentially around the perimeter of the support surface, an error input sensor adapted to be located proximate a spatial zone in which noise attenuation is desired, a control output transducer, and a control unit executing an adaptive algorithm. The control unit is in data communication with the array of reference input sensors, the error input sensor, and the control output transducer. The spatial zone is within the bounds of the support surface. The adaptive algorithm is configured to utilize input signals from the array of reference input sensors and the error input sensor to generate a control signal for the control output transducer. The control signal, when broadcast by the control output transducer, generates a control sound wave that is configured to destructively interfere with noise sound waves from the noise source or sources when the noise sound waves enter the spatial zone.

BRIEF SUMMARY OF THE INVENTION

It is a fundamental objective of the present invention to minimize and overcome the obstacles and challenges of the prior art. In the following description, numerous details are set forth to provide a more thorough explanation of embodiments of the present invention. It will be apparent, however, to one skilled in the art, that embodiments of the present invention may be practiced without these specific details. As used herein, unless otherwise indicated, "or" does not require mutual exclusivity.

As generally disclosed in U.S. Pat. No. 10,410,619, an active noise control system may be provided for use proximate a support surface in an environment with multiple noise sources that emit noise sound waves either on a constant, periodic, or irregular basis. Components of such an active noise control system include an array of reference input sensors arranged essentially around the perimeter of the support surface, an error input sensor adapted to be located proximate a spatial zone in which noise attenuation is desired, a control output transducer, and a control unit executing an adaptive algorithm. The control unit is in data communication with one or more of the reference input sensors, the error input sensor, and the control output transducer. The spatial zone is within the bounds of the support surface. The ANC system includes an adaptive algorithm configured to utilize input signals from the one or more reference input sensors and the error input sensor to generate a control signal for the control output transducer. The control signal, when broadcast by the control output transducer, generates a control sound wave that is configured to destructively interfere with noise sound waves from the noise source or sources when the noise sound waves enter the spatial zone.

To provide improved active noise control systems, support structures for specific components of such an active noise control system in enclosed space situations are described, including control output transducers and error sensors located within an enclosed space. These support structures provide fixed spatial position and orientation for the components relative to the internal volume of the enclosed space and the spatial zone where noise attenuation is desired.

These and other aspects of the devices of the invention are described in the figures, description, and claims that follow.

DETAILED DESCRIPTION OF THE INVENTION

Figure 1:
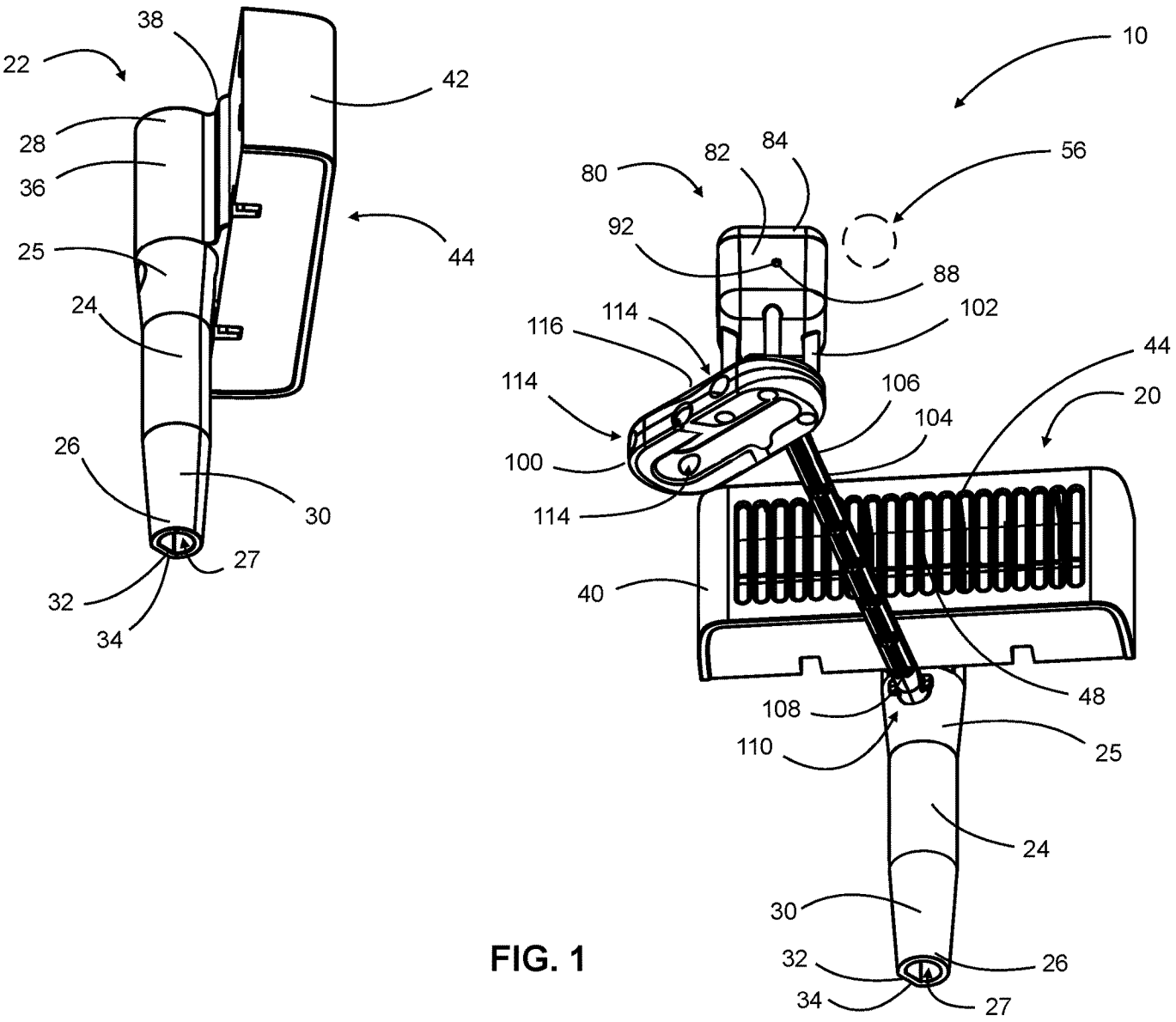
FIG. 1 shows a perspective view of an embodiment of the present invention.
Figure 4:
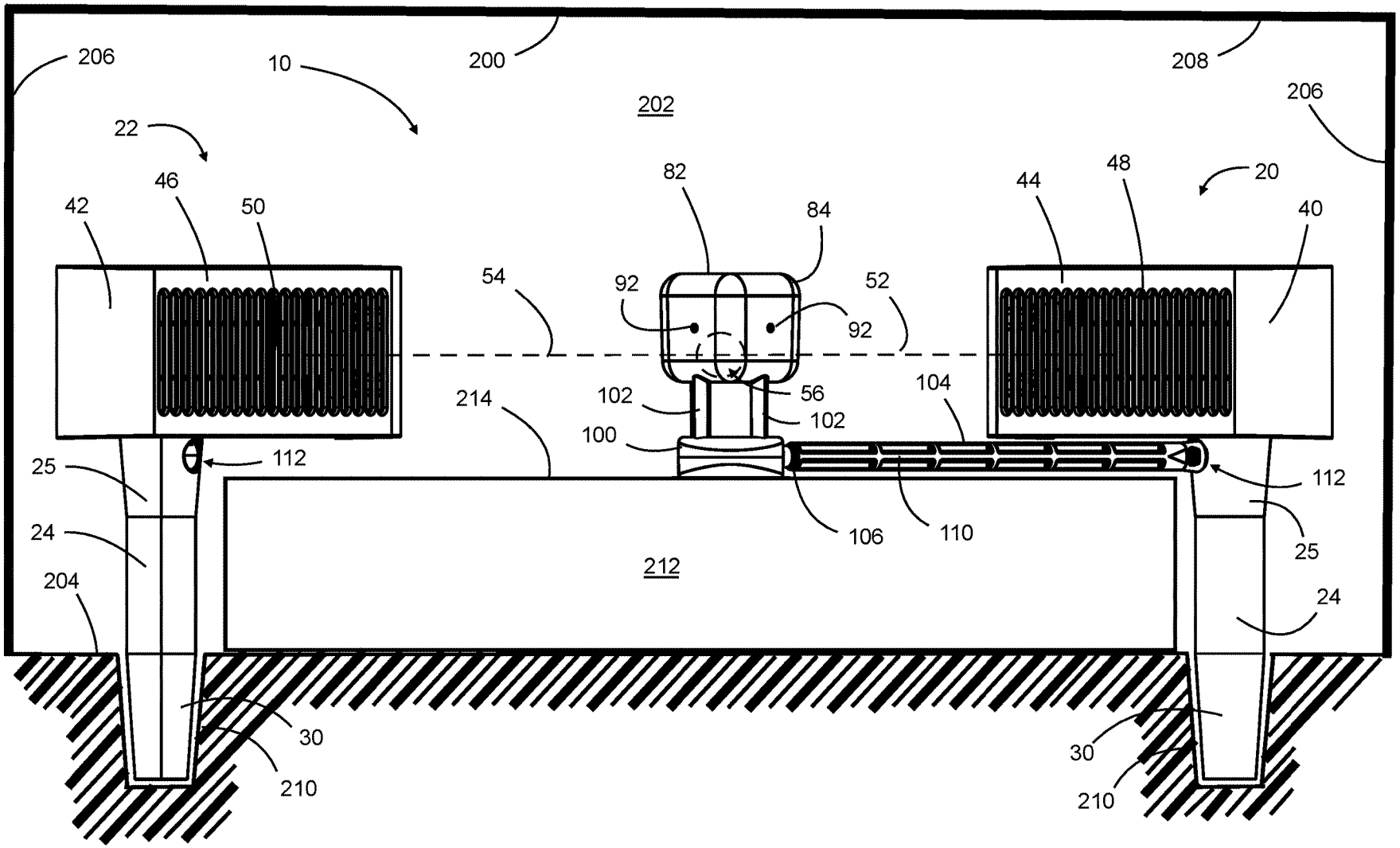
FIG. 4 shows a front view of the present invention in an incubator housing.

Referring to FIGS. 1 and 4, a support structure 10 for selected components of an Active Noise Control (ANC) system in an enclosed volume is shown. Generally, support structure 10 is provided within an enclosed volume 202, and includes a first post structure 20 and a second post structure 22. Supported components described herein may be coupled to additional components of an ANC system, for example an ANC system for use with neonatal incubators as described in U.S. Pat. No. 10,401,619, the contents of which are incorporated by reference in their entirety. The ANC system described therein may include, for example, additional components such as reference input sensors, control units, selector mechanisms, etc. which cooperate with the selected supported components shown herein to fully implement an ANC system.

In a typical embodiment, patient support 212 includes a support surface 214 as would be used to support a human occupant, for example a hospital patient. In typical embodiments, the support surface 214 will be generally planar and generally horizontal. In other embodiments, the support surface may be contoured to comfortably support an occupant. A spatial zone 58 is located within the perimeter of the support surface 214, defining a volume above the support surface 214 (when viewed in three dimensions) where the head of an occupant will typically be located. The hospital patient may be an infant and the support surface 214 may be an incubator, crib, or bassinet. The hospital patient may also be a pediatric patient or an adult patient and the support surface 214 may be a hospital bed.

In one embodiment an ANC support structure 10 is provided for inclusion within a neonatal incubator 200 having an internal volume 202. Internal volume 202 of neonatal incubator 200 is generally defined by a bottom wall 204, one or more side walls 206, and a top wall 208. Bottom wall 204 of incubator 200 is generally horizontal and generally planar to support a patient support 212, for example a cushion material or mattress 212. In some embodiments, bottom wall 204 may have some non-horizontal and some non-planar portions, or be non-horizontal and/or non-planar. Side wall or side walls 204 of incubator 200 may be a single generally oval side wall, several generally rectangular or trapezoidal side walls 204, or other configurations consistent with a neonatal incubator 200, as is generally known in the art.

Referring to FIGS. 1-4, each post structure 20, 22 includes a generally cylindrical support post 24 having a bottom end 26 and a top end 28. The diameter of generally cylindrical support posts 24 may be constant or may vary. For example, a post 20, 22 may include a tapered or frustoconical section 25 to smoothly transition from one diameter of post 24 to another diameter. In other embodiments, post 24 may include one or more stepwise or curved changes of diameter. In some embodiments, post 24 may have a central cylindrical hollow cavity 27 extending from bottom end 26 to top end 28, such that wiring associated with components of a noise cancellation system may be routed through hollow cavity 27. As shown, bottom end 26 includes an annular opening to hollow cavity 27, while top end 28 is closed. In other embodiments, top end 28 may also include an annular opening connected to hollow cavity 27. In still other embodiments, posts 20, 22 may have a non-circular cross section, such as an oval, ellipsoid, square or rectangular, trapezoidal, etc. In still other embodiments, the cross-section of posts 20, 22 may be a cross, X, or star.

Bottom wall 204 includes tapered post receiving openings 210 to permit insertion and removal of support posts 20, 22. Bottom section 30 of each cylindrical support post 20, 22 is preferably provided with a gradually reducing taper from cylindrical support post 24 towards bottom end 26, to thereby facilitate insertion of bottom section 30 into correspondingly tapered receptacle openings 210 of bottom wall 204, as shown in FIG. 4. In a typical embodiment, posts 20, 22 are perpendicular to the horizontal plane of bottom wall 204. In other embodiments, posts 20, 22, may be at a non-perpendicular angle to bottom wall 204 when inserted into receptacle openings 210.

Bottom section 30 of each cylindrical support post 24 is further provided with an orientation feature 32, shown here as an alignment flat 34. In a preferred embodiment, orientation feature 32 permits insertion of bottom section 30 of posts 20, 22 into a unique rotational orientation with respect to corresponding receptacle opening 210. In other embodiments, the rotational orientation feature 32 may, for example, be a protuberance extending from bottom section 30 proximate to bottom end 26, or a non-cylindrical cross-sectional shape of bottom section 30 requiring a unique orientation of bottom section 30 within receptacle opening 210. In some embodiments, the rotational orientation features 32 of posts 20, 22 may be mutually incompatible to ensure that the relative positions of posts 20, 22 and their associated ANC system components cannot be inadvertently switched by a user. In other embodiments, for example where the support posts 20, 22 have a generally ellipsoidal or trapezoidal cross-section, the rotational orientation feature may be an inherent feature of the selected cross-section.

Top section 36 of each cylindrical support post 20, 22 support first and second output transducer housings 40, 42 of an ANC system. Output transducer housings 40, 42 are mechanically coupled to top sections 36 to fix the position of output transducer housings 40, 42 relative to cylindrical support posts 20, 22 and their respective rotational orientation features 30. In the embodiment shown, output transducer housings 40, 42 are coupled to posts 20, 22 by mounting flanges 38. In other embodiments, output transduced housings 40, 42 may be integrally formed with posts 20, 22. In a preferred embodiment, mounting flanges 38 irremovably couple output transducer housings 40, 42 to respective posts 20, 22. In other embodiments, output transducer housings may be removably coupled to respective posts 20, 22. In either embodiment, insertion of posts 20, 22 into receptacle openings 210 of incubator bottom wall 204 thereby fixes the positions of output transducer housings 40, 42 relative to each other and to the internal volume 202 of incubator 200.

Figure 2:
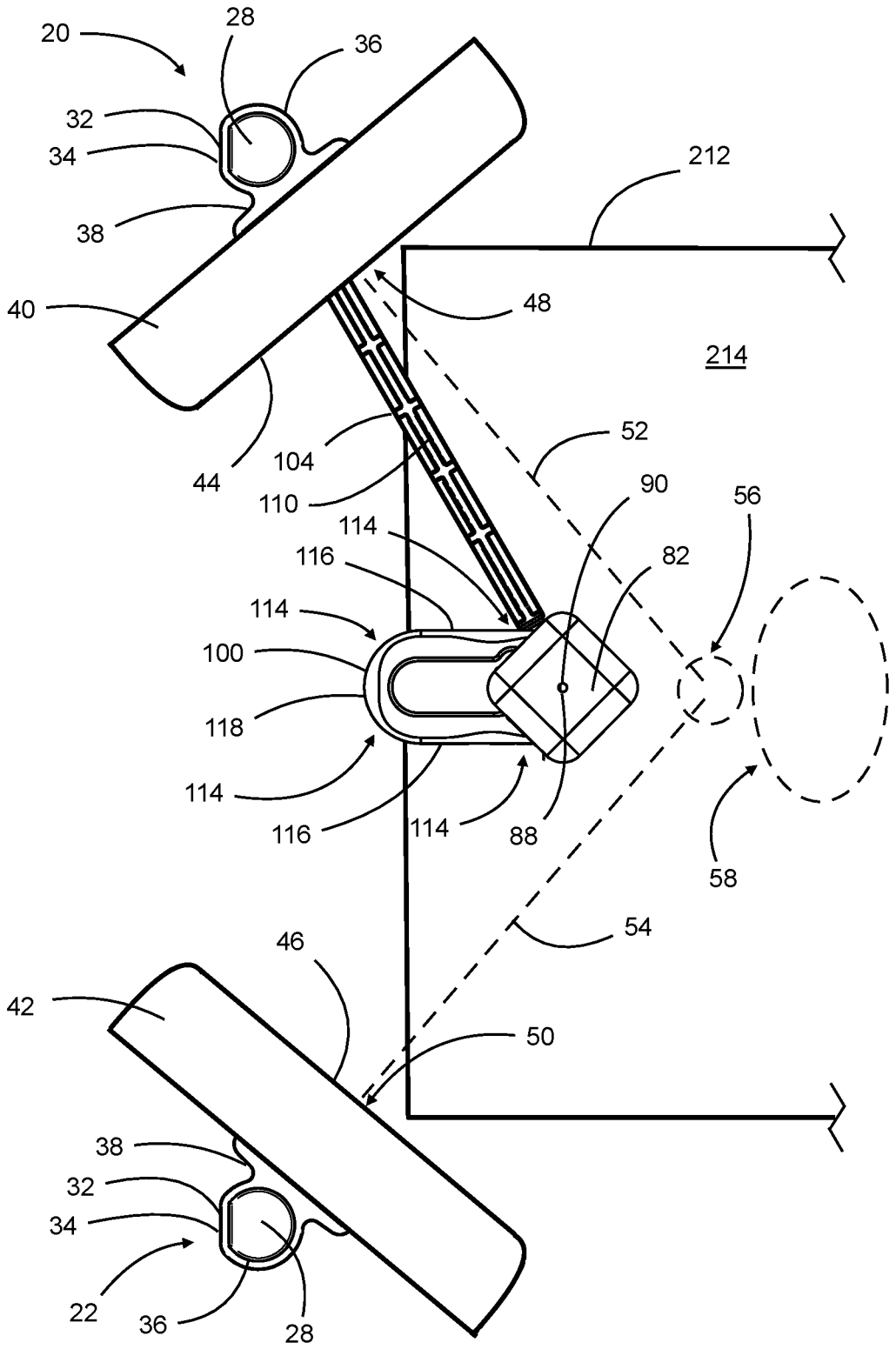
FIG. 2 shows a top plan view of the present invention.
Figure 3:
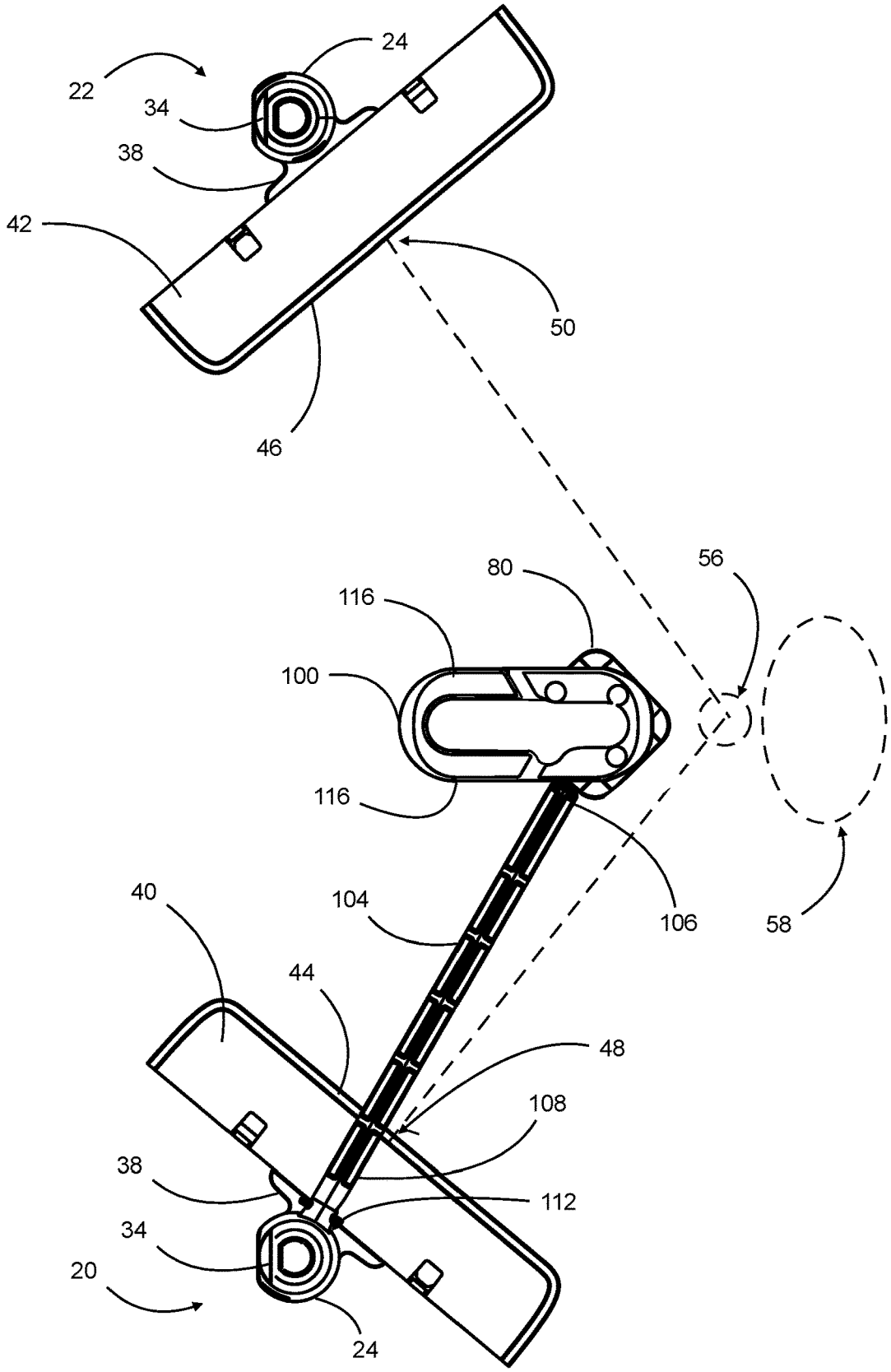
FIG. 3 shows a bottom plan view of the present invention.

As shown in FIGS. 1 and 2, output transducer housings 40, 42 include respective front faces 44, 46 and internally mounted output transducers 48, 50, such as the output transducers generally described in U.S. Pat. No. 10,410,619 in connection with active noise control systems. In a preferred embodiment, output transducers 48, 50 are acoustic speakers with axial output directions, shown as respective axial output direction lines 52, 54. In a preferred embodiment, axial output directions 52, 54 of output transducers 48, 50 are generally perpendicular to front faces 44, 46 of output transducer housings and generally parallel to bottom wall 204 and mattress top surface 214. In other embodiments, axial output directions 52, 54 of output transducers 48, 50 may be angled with respect to front faces 44, 46 of output transducer housings, and may be angled with respect to bottom wall 204 and mattress top surface 214.

Each axial output direction 52, 54 of output transducers 48, 50 is fixed via mechanical connection through output transducer housings 40, 42, flanges 38, and posts 20, 22 with respect to incubator 200 and bottom wall 204 such that axial output direction lines 52, 54 intersect at a point within incubator volume 202 that is above mattress surface 214. The intersection of the acoustic outputs of output transducers 48, 50 in the immediate vicinity of the intersection of axial output direction lines 52, 54, indicated by dashed circle 56 in FIGS. 2-4. The respective orientations of output transducers 40, 42 are selected such that intersection 56 is proximate to a spatial zone 58 within internal volume 202 of incubator 200 in which noise attenuation is desired. In some embodiments, intersection 56 may partially overlap or be contained within spatial zone 58.

The supported ANC system components further include an error input sensor housing 80 positioned proximate intersection 56, spatial zone 58, and support surface 214. In some enclosed volumes, one or more acoustic nodes may exist due to the configuration of enclosed volume. For example, an acoustic node may exist on or near the midpoint between side walls 204 of an internal volume 202. Accordingly, in preferred embodiments, sensor housing 80 is oriented away from such an acoustic node or nodes, while remaining proximate to the spatial zone 58 where noise attenuation is desired.

The error input sensor housing 80 includes one or more error input sensors 88. In typical embodiments, the error input sensors 88 are in data communication with additional components of an ANC system, including a control unit and input sensors (not shown), as described in U.S. Pat. No. 10,410,619, thereby providing an error signal to an active noise control algorithm. The error input sensor 88 is generally a microphone adapted to respond to sound pressure levels. In some embodiments, more than one microphone may be used. In other embodiments, other sensor types are also appropriate for use as an error correction sensor or sensors. In the embodiment show, sensor housing 80 includes six error input sensors 88, including a top sensor 90 (as shown in FIG. 2) and four side sensors 92 (one on each side, as shown on FIGS. 1 and 4), and a bottom sensor on the face of housing 80 opposed to top sensor 92.

In the embodiment shown, error input sensor housing generally takes the form of a cube 82 having rounded edges and corners 84. In other embodiments, the sensor housing 80 may be any shape, such as sphere or spheroid, suitable for proper placement of one or more error input sensors 88. In the embodiment shown, the error input sensor housing 80 is positioned vertically above the support surface 214. In other embodiments, the error input sensor housing is integral with the support surface 214.

In the embodiment shown, sensor housing 80 is maintained in a fixed position relative to output transducer housings 40, 42 and internally mounted output transducers 48, 50 by mechanical coupling to a sled 100 via one or more pegs 102. Sled 100 is positioned proximate to support surface 214, and may be in direct contact with support surface 214 or positioned a small distance, for example 1 cm, 5 cm, or 10 cm, above the support surface 214. Pegs 102 separate error sensor housing 80 from sled 10, for example by 0.5 cm, 1 cm, 2 cm, or more. Sled 100 is generally planar, and may be provided in the racetrack shape as shown, an oval, a circle, a rectangle, or another shape. In one embodiment, sled 100 is shaped as two coplanar disks blended into a smooth figure-8 configuration.

Sled 100 is mechanically fixed to at least one of posts 20, 22 by at least one connecting rod 104. When connected to a post, rod 104 extends generally perpendicularly from the post. Rod 104 includes a sled rod end 106 and a post rod end 108. In the embodiment shown, rod 104 includes linear and transverse ribs 110 to increase structural strength while minimizing material use and weight. In other embodiments, rod 104 may have generally oval, rectangular, or another other cross-section.

Each post 20, 22 includes a post rod opening 112 sized to receive a post rod end 108 and mechanically couple connecting rod 104 to post 20. In some embodiments, post rod openings 112 are an annular opening in posts 24 and are connected to hollow cavity 27 of posts 24. In preferred embodiments, post rod end 108 and post rod opening 112 include compatible alignment features, such as a keyed opening shape and rod end cross sectional shape, to ensure positioning of sled 100 in horizontal and parallel alignment with respect to support surface 214 and incubator bottom wall 204.

In a preferred embodiment, sled 100 includes at least one sled rod opening 114 on each side 116 of sled sized to receive sled rod end 106 of connecting rod 104. Sled 100 may include sled rod openings 114 positioned on side 116, and may further include sled rod openings 114 proximate to curved sled end 118. In preferred embodiments, post rod end 106 and sled rod opening 114 include compatible alignment features, such as a keyed opening shape and rod end cross sectional shape, to ensure positioning of sled 100 in horizontal and parallel alignment with respect to support surface 214 and incubator bottom wall 204. As best shown in FIG. 1, each side 116 of sled 100 includes two sled rod openings 114, one proximate to error input sensor housing 80 and one proximate to sled rear end 118, allowing error input sensor housing 80 to be moved spatially proximate or distal to an acoustic node that may exist in internal volume 202. Additionally, the length of rod 104 may be selected such that sensor housing 80 is not coincident with an acoustic node of internal volume 202.

In a preferred embodiment, a single post rod 104 couples sled 100 to a post, shown here as post 20. In other embodiments, a second rod 104 may further couple sled 100 to post 22 via a second post rod opening and a second sled rod opening. When sled 100 is coupled to connecting rod 104 at a sled rod opening 114 and connecting rod 104 is coupled to post 20 at a rod opening 112, the supported ANC system components (error input sensor housing 80 including input sensors 88, and output transducers 48, 50) are positionally fixed with respect to each other and with respect to spatial zone 58, permitting accurate operation of an ANC algorithm for noise reduction in the target spatial zone 58.

The invention may be embodied in other specific forms without departing from the spirit or essential characteristics thereof. The foregoing embodiments are therefore to be considered in all respects illustrative rather than limiting on the invention described herein. Scope of the invention is thus indicated by the appended claims rather than by the foregoing description and all changes that come within the meaning and range of equivalency of the claims are therefore intended to be embraced therein.

All references cited in this specification are hereby incorporated by reference. The discussion of the references herein is intended merely to summarize the assertions made by the authors and no admission is made that any reference constitutes prior art. Applicants reserve the right to challenge the accuracy and pertinence of the cited references.

We claim:

1. An apparatus comprising:

a first post, the first post having a first top portion and a first tapered bottom portion, wherein the first top portion includes a first output transducer;

a second post, the second post having a second top portion and a second tapered bottom portion, wherein the second top portion includes a second output transducer;

a connecting rod extending perpendicularly from a middle portion of the first post; and a sensor housing coupled to a rod end distal to the first post.

2. The apparatus of claim 1, wherein the first post is generally cylindrical and the second post is generally cylindrical.

3. The apparatus of claim 2, wherein the second bottom tapered portion comprises a second alignment feature.

4. The apparatus of claim 3, wherein the first alignment feature and the second alignment feature are distinct.

5. The apparatus of claim 1, wherein the first bottom tapered portion comprises a first alignment feature.

6. The apparatus of claim 1, wherein the sensor housing comprises a microphone.

7. The apparatus of claim 1, wherein the sensor housing comprises a sled interposed between the rod end and the sensor housing.

8. The apparatus of claim 7, wherein the sled comprises at least one first side opening to adjustably receive the rod end distal to the first post.

9. The apparatus of claim 7, wherein the sled comprises at least one second side opening to adjustably receive the rod end distal to the first post.

10. The apparatus of claim 1, wherein a rod end proximate to the first post is removably received in a post rod opening.

11. The apparatus of claim 1, wherein first output transducer and the second output transducer are coupled to an active noise cancellation control module.

12. A support structure for noise cancellation system components, the support structure comprising:

An enclosed volume;

a first post within the enclosed volume having a first top end and a first bottom end; and a second post within the enclosed volume having a second top end and a second bottom end;

wherein the first post includes a first noise cancellation output transducer at the first top end, and the second post includes a second noise cancellation output transducer at the second top end, wherein the first bottom end includes a first orientation feature, and the second bottom end includes a second orientation feature, and wherein the first orientation feature orients the first output transducer when the first bottom end is received in a first post receiving opening, and the second orientation feature orients the second output transducer when the second bottom end is received in a second post receiving opening.

13. The support structure of claim 12, further comprising a generally horizontal and generally planar bottom wall, and wherein the first post and second post are perpendicular to the bottom wall when respectively received in the first post receiving opening and the second post receiving opening.

14. The support structure of claim 12, further comprising a connecting rod and a sled, wherein the sled is removably connected to the first post by the connecting rod.

15. The support structure of claim 14, further comprising a sensor housing coupled to the sled.

16. The support structure of claim 15, the sensor housing further comprising a noise cancellation error input microphone.

17. The support structure of claim 15, the sensor housing further comprising a plurality of noise cancellation error input microphones.

18. The support structure of claim 12, wherein the first post and the second post are generally cylindrical.

19. The support structure of claim 12, wherein the first post and the second post are hollow.

20. The support structure of claim 12, wherein first output transducer and the second output transducer are coupled to an active noise cancellation control module.

* * * * *